US011205538B2

(12) United States Patent
Moon et al.

(10) Patent No.: US 11,205,538 B2
(45) Date of Patent: Dec. 21, 2021

(54) INDUCTOR AND METHOD OF MANUFACTURING THE SAME

(71) Applicant: SAMSUNG ELECTRO-MECHANICS CO., LTD., Suwon-Si (KR)

(72) Inventors: Sung Min Moon, Suwon-Si (KR); Cheol Soon Kim, Suwon-Si (KR); Yu Jong Kim, Suwon-Si (KR); Dong Min Kim, Suwon-Si (KR); Young Do Choi, Suwon-Si (KR); Tae Ryung Hu, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 300 days.

(21) Appl. No.: 15/982,645

(22) Filed: May 17, 2018

(65) Prior Publication Data

US 2019/0180913 A1 Jun. 13, 2019

(30) Foreign Application Priority Data

Dec. 11, 2017 (KR) ..... 10-2017-0169456

(51) Int. Cl.
*H01F 27/29* (2006.01)
*H01F 27/28* (2006.01)
(Continued)

(52) U.S. Cl.
CPC ..... *H01F 27/2804* (2013.01); *H01F 17/0013* (2013.01); *H01F 17/04* (2013.01);
(Continued)

(58) Field of Classification Search
CPC ..... H01F 17/006; H01F 41/04; H01F 5/003; H01F 27/29; H01F 2027/2809;
(Continued)

(56) References Cited

U.S. PATENT DOCUMENTS 4,416,056 A * 11/1983 Takahashi ..... G11B 5/313 29/602.1
6,600,404 B1 * 7/2003 Kajino ..... H01F 5/003 257/531

(Continued)

FOREIGN PATENT DOCUMENTS

JP S56-15012 U 7/1954
JP S61-124117 A 6/1986

(Continued)

OTHER PUBLICATIONS

Office Action issued in corresponding Korean Application No. 10-2017-0169456, dated Feb. 14, 2019.

(Continued)

*Primary Examiner* — Alexander Talpalatski
*Assistant Examiner* — Joselito Baisa
(74) *Attorney, Agent, or Firm* — Morgan, Lewis & Bockius LLP

(57) ABSTRACT

An inductor includes: a body including a support member including a through-hole and a via hole, an insulator disposed on the support member and including a first opening exposing portions of the support member, and a coil pattern disposed in the first opening, and including a plurality of layers including a seed layer in contact with the support member; and an external electrode disposed on an external surface of the body and electrically connected to the coil pattern. The support member may have a multilayer structure of at least first and second insulating layers, and the via hole may penetrate through both of the first and second insulating layers.

18 Claims, 11 Drawing Sheets

(51) Int. Cl.

| | |
|---|---|
| ***H01F 41/04*** | (2006.01) |
| ***H01F 41/12*** | (2006.01) |
| ***H01F 27/32*** | (2006.01) |
| ***H01F 17/00*** | (2006.01) |
| ***H01F 17/04*** | (2006.01) |

(52) U.S. Cl.
CPC ..... *H01F 27/29* (2013.01); *H01F 27/292* (2013.01); *H01F 27/32* (2013.01); *H01F 27/323* (2013.01); *H01F 41/042* (2013.01); *H01F 41/046* (2013.01); *H01F 41/12* (2013.01); *H01F 41/122* (2013.01); *H01F 2017/048* (2013.01); *H01F 2027/2809* (2013.01)

(58) Field of Classification Search
CPC ... H01F 27/2804; H01F 27/323; H01L 28/10; H01L 23/5227
USPC ..... 336/200
See application file for complete search history.

(56) References Cited

U.S. PATENT DOCUMENTS

| | | | | |
|---|---|---|---|---|
| 7,111,384 | B2 * | 9/2006 | Yamada | G11B 5/17 29/603.07 |
| 7,194,798 | B2 * | 3/2007 | Bonhote | G11B 5/1272 205/118 |
| 7,759,776 | B2 * | 7/2010 | Cheng | G01R 1/07378 257/668 |
| 8,178,435 | B2 * | 5/2012 | Lin | H01L 24/05 438/622 |
| 8,410,576 | B2 * | 4/2013 | Smeys | H01L 23/5227 257/531 |
| 9,331,009 | B2 * | 5/2016 | Choi | H01L 21/486 |
| 9,514,880 | B2 * | 12/2016 | Park | H01F 41/041 |
| 9,595,384 | B2 * | 3/2017 | Nakamura | H01F 17/0013 |
| 9,911,530 | B2 * | 3/2018 | Yang | H01F 17/0013 |
| 9,928,953 | B2 * | 3/2018 | Jeon | H01F 27/255 |
| 10,199,154 | B2 * | 2/2019 | Hong | H01F 27/255 |
| 10,304,620 | B2 * | 5/2019 | Lee | H01F 27/324 |
| 10,515,752 | B2 * | 12/2019 | Choi | H01F 27/323 |
| 10,804,025 | B2 * | 10/2020 | Jang | H01F 27/02 |
| 2003/0122175 | A1 * | 7/2003 | Buskirk | H01L 27/0805 257/310 |
| 2004/0217440 | A1 * | 11/2004 | Ng | H01L 23/5227 257/528 |
| 2011/0310579 | A1 * | 12/2011 | Smeys | H01F 17/04 361/782 |
| 2013/0222101 | A1 * | 8/2013 | Ito | H01F 5/003 336/83 |
| 2014/0009254 | A1 * | 1/2014 | Ohkubo | H01F 27/29 336/192 |
| 2015/0294789 | A1 * | 10/2015 | Sano | H01F 17/0013 205/78 |
| 2015/0325510 | A1 | 11/2015 | Choi et al. | |
| 2016/0005527 | A1 | 1/2016 | Park et al. | |
| 2016/0293320 | A1 * | 10/2016 | Kim | H01F 17/0013 |
| 2017/0140866 | A1 * | 5/2017 | Hong | H01F 27/245 |
| 2017/0178789 | A1 | 6/2017 | Kim et al. | |
| 2017/0287621 | A1 * | 10/2017 | Seino | H01F 1/28 |
| 2017/0330674 | A1 | 11/2017 | Lee et al. | |

FOREIGN PATENT DOCUMENTS

| | | | |
|---|---|---|---|
| JP | 2006-332147 | A | 12/2006 |
| JP | 2007-067214 | A | 3/2007 |
| JP | 2009-010268 | A | 1/2009 |
| JP | 2017-17139 | A | 1/2017 |
| JP | 2017-204629 | A | 11/2017 |
| KR | 10-1999-0066108 | A | 8/1999 |
| KR | 10-2015-0127999 | A | 11/2015 |
| KR | 10-2017-0073167 | A | 6/2017 |

OTHER PUBLICATIONS

Office Action issued in corresponding Japanese Patent Application No. 2018-098322 dated Oct. 9, 2018.

* cited by examiner

S101

S102

INDUCTOR AND METHOD OF MANUFACTURING THE SAME

CROSS-REFERENCE TO RELATED APPLICATION(S)

This application claims benefit of priority to Korean Patent Application No. 10-2017-0169456 filed on Dec. 11, 2017 in the Korean Intellectual Property Office, the disclosure of which is incorporated herein by reference in its entirety.

TECHNICAL FIELD

The present disclosure relates to an inductor and a method of manufacturing the same, and more particularly, to a thin film type power inductor advantageous in terms of an increase in an inductance and miniaturization, and a method of manufacturing the same.

BACKGROUND

In accordance with the development of information technology (IT), apparatuses have been rapidly miniaturized and thinned. Therefore, a market demand for small thin devices has increased.

In accordance with such a technical trend, Korean Patent Laid-Open Publication No. 10-1999-0066108 provides a power inductor including a substrate having a via hole and coils disposed on opposite surfaces of the substrate and electrically connected to each other through the via hole of the substrate to make an effort to provide an inductor including coils having a uniform and large aspect ratio.

SUMMARY

An aspect of the present disclosure may provide an inductor of which both of electrical characteristics including Rdc characteristics and reliability may be improved by making a line width of a coil pattern in the inductor fine, and a method of manufacturing the same.

According to an aspect of the present disclosure, an inductor may include: a body including a support member including a through-hole and a via hole, an insulator disposed on the support member and including a first opening exposing portions of the support member, and a coil pattern disposed in the first opening, and including a plurality of layers including a seed layer in contact with the support member; and an external electrode disposed on an external surface of the body and electrically connected to the coil pattern. The support member may have a multilayer structure of at least first and second insulating layers, and the via hole may penetrate through both of the first and second insulating layers.

According to another aspect of the present disclosure, a method of manufacturing an inductor may include: preparing a substrate; laminating a first insulator on the substrate; patterning the first insulator to have a first opening to expose portions of the substrate; forming a first coil pattern in the first opening; laminating a first insulating layer on the first coil pattern and the first insulator; laminating a second insulating layer on the first insulating layer; opening at least portions of the second insulating layer so that the first insulating layer is exposed by removing at least portions of the second insulating layer; forming a thin film conductor layer disposed on the first and second insulating layers; removing portions of the thin film conductor layer to convert a remaining portion of the thin film conductor layer to a seed layer; laminating a second insulator to embed the seed layer; patterning the second insulator to have a second opening exposing at least the seed layer; forming a plating layer in the second opening so as to form a second coil pattern including the seed layer and the plating layer; removing the substrate to form a coil portion including the first and second coil patterns and the first and second insulating layers disposed therebetween; and forming an external electrode connected to the first and second coil patterns of the coil portion.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, an inductor and a method of manufacturing the same according to an exemplary embodiment in the present disclosure will be described. However, the present disclosure is not necessarily limited thereto.

Inductor

Figure 1:
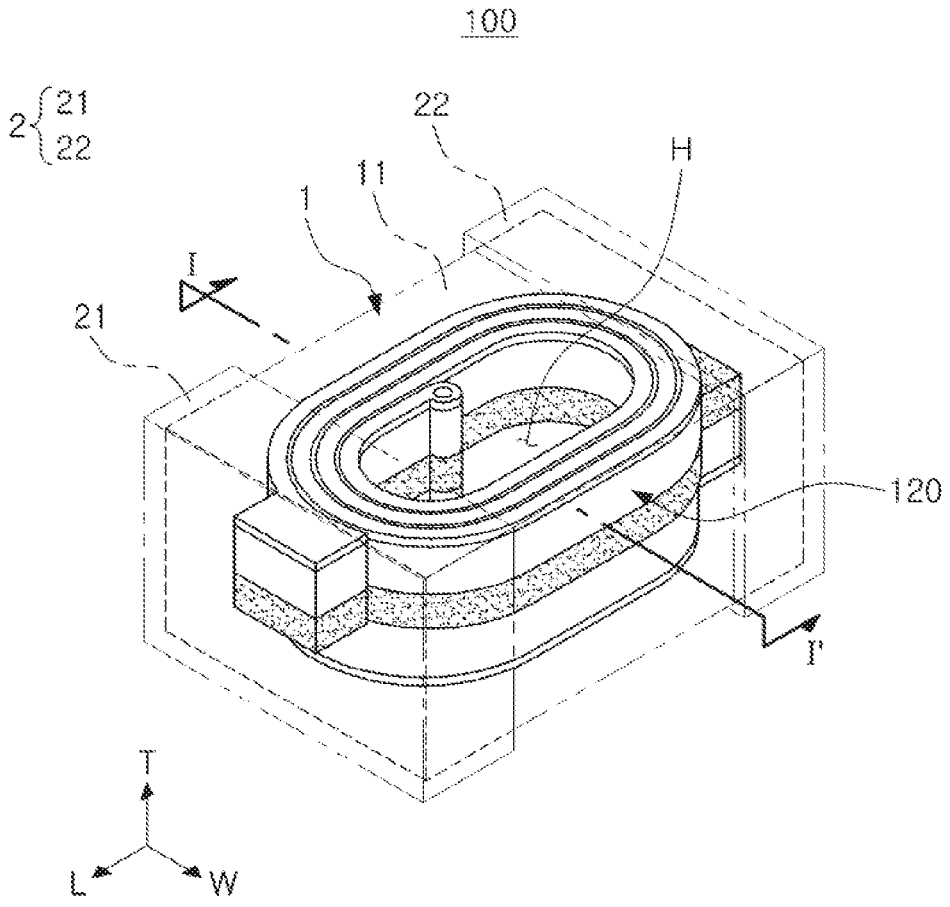
FIG. 1 is a perspective view illustrating an inductor according to an exemplary embodiment in the present disclosure.
Figure 2:
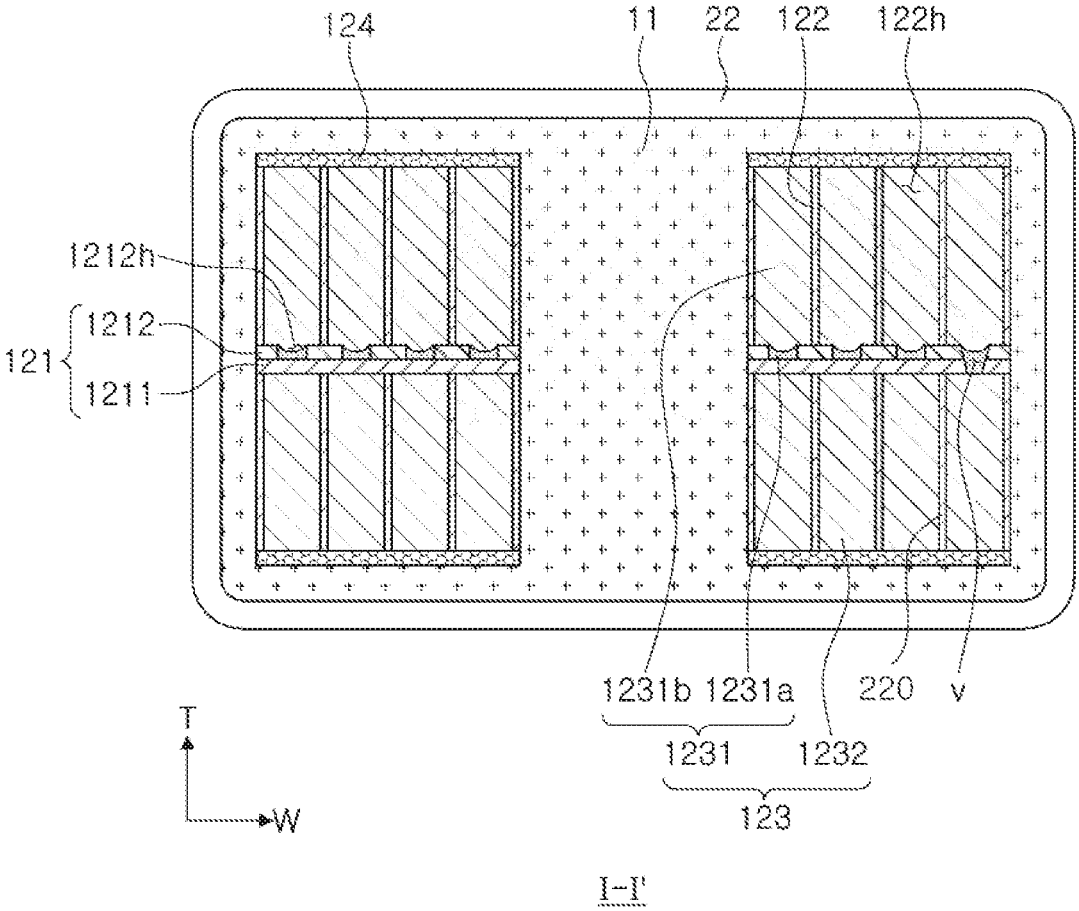
FIG. 2 is a cross-sectional view taken along line I-I' of FIG. 1.

FIG. 1 is a perspective view illustrating an inductor according to an exemplary embodiment in the present disclosure, and FIG. 2 is a cross-sectional view taken along line I-I' of FIG. 1.

Referring to FIGS. 1 and 2, an inductor 100 may include a body 1 and an external electrode 2 disposed on an external surface of the body. The external electrode may include first and second external electrodes 21 and 22 functioning as different polarities.

The body 1 may form an appearance of the inductor, and may have upper and lower surfaces opposing each other in a thickness direction T, first and second end surfaces opposing each other in a length direction L, and first and second side surfaces opposing each other in a width direction W to thus substantially have a hexahedral shape.

The body 1 may include a magnetic material 11 having a magnetic property. The magnetic material may be appropriately selected as needed by those skilled in the art, and may be, for example, a metal-resin composite in which ferrite or metal magnetic particles are dispersed in a resin.

A coil portion 120 may be encapsulated by the magnetic material 11, and may include a support member 121, insulators 122 and 220 supported by the support member 121 and having an opening patterns 122*h* and 220*h*, and a coil pattern 123 supported by the support member 121 and filing the opening patterns 122*h* and 220*h*.

The support member 121 in the coil portion may include a through-hole H and a via hole v spaced apart from the through-hole and disposed in the vicinity of the through-hole. The through-hole may be filled with the magnetic material to serve to enhance a magnetic flux generated from a coil. The via hole may be formed of an aggregate of a plurality of via holes, and may be provided to remove a risk that an open defect of a via will occur. The via hole may be a space in which a via electrically connecting coil patterns disposed on and beneath the support member 121 to each other is to be formed. The via may be formed by filling the via hole with the conductive material. The support member 121 may have a multilayer structure including at least a first insulating layer 1211 and a second insulating layer 1212, and the via hole v may penetrate through both of the first and second insulating layers 1211 and 1212. The first insulating layer 1211 of the support member 121 may have a thin film sheet shape, and may be formed of a material having an insulation property. A specific thickness of the first insulating layer 1211 may be appropriately selected by those skilled in the art, but maybe advantageous that a thickness of the first insulating layer 1211 is small in order to form a coil pattern having a high aspect ratio in an inductor having a low profile. For example, the thickness of the first insulating layer 1211 may be 10 μm or more and less than 60 μm. Since a thickness of a center core of a clad copper laminate (CCL), which is any known material of the support member 121, is approximately 60 μm, it may be difficult to satisfy a demand for the inductor having the low profile using the CCL. On the other hand, a thickness of the first insulating layer 1211 of the support member 121 of the inductor 100 according to the present disclosure is decreased up to approximately 10 μm, and the inductor including the coil having a significantly increased aspect ratio and being thinned may thus be easily provided. The material of the first insulating layer 1211 is not limited as long as it has an insulation property, and may include a glass filler, or the like, for rigidity or may be a photoimagable dielectric (PID) resin, an Ajinomoto build-up film (ABF), FR-4, or the like, but is not limited thereto.

Next, the second insulating layer 1212 stacked on the first insulating layer 1211 may be patterned to have predetermined openings 1212*h*. A general cross-sectional shape of the predetermined opening may correspond to that of the coil pattern. For example, the general cross-sectional shape of the predetermined opening may be, for example, a predetermined spiral shape, but is not limited thereto. A thickness of the opening 1212*h* of the second insulating layer 1212 may be substantially the same as that of the second insulating layer 1212. The reason is that portions of an upper surface of the first insulating layer 1211 stacked beneath the second insulating layer 1212 are exposed by the openings. A thickness of the second insulating layer 1212 may be 5 μm or more 20 μm or less. When the thickness of the second insulating layer 1212 is smaller than 5 μm, it may be difficult to handle the second insulating layer 1212 in a process and it may not be easy to secure rigidity enough to support the coil pattern, and when the thickness of the second insulating layer 1212 is greater than 20 μm, there maybe a limitation in satisfying a demand for thinness of a chip.

Since the support member 121 have the multilayer structure of the first insulating layer 1211 and the second insulating layer 1212, even though the thickness of the first insulating layer is significantly decreased, a difficulty in controlling a material in performing a process may be decreased. In detail, when the first insulating layer 1211 has a small thickness of approximately 10 μm, it may not be easy that the coil pattern or the insulator 122 is stably supported on the first insulating layer 1211. However, when the second insulating layer 1212 is stacked on the first insulating layer 1211, mechanical strength and processing easiness of the support member 121 may be increased, and since the second insulating layer 1212 includes the openings, the coil pattern may be formed in the openings, which is advantageous in increasing a thickness of the coil.

In addition, an angle formed by a side surface of the opening 1212*h* and the first insulating layer 1211 may be an acute angle or an obtuse angle as well as a right angle. Therefore, a specific gradient of the side surface of the opening 1212*h* is not limited.

A material of the second insulating layer 1212 is not limited as long as a pattern including the openings is easily patterned and it has an insulation property and processing easiness, and may be, for example, a PID resin, an ABF, or the like.

A line width of the opening 1212*h* is not particularly limited. However, it may be advantageous that the line width of the opening 1212*h* is small and a line width of the second insulating layer 1212 is great in order to facilitate alignment of the insulator 122 disposed on the second insulating layer 1212.

The insulator 122 including openings 122*h* may be disposed on the second insulating layer 1212. The opening 122*h* may have a shape corresponding to that of the opening 1212*h* of the second insulating layer 1212, and a line width of the opening 122*h* of the insulator 122 may be greater than that of the opening 1212*h* of the second insulating layer 1212. The reason is that a seed layer 1231*a* is disposed in the opening 1212*h* of the second insulating layer 1212, while a plating layer 1231*b* substantially determining a thickness of the coil in the coil pattern is disposed in the opening 122*h* of the insulator 122.

The coil pattern 123 supported by the support member 121 will be described. The coil pattern may include coil patterns connected to each other to have a generally spiral shape, but having a T-shaped cross section in a cross section cut in an L-T direction. In detail, the coil pattern 123 may include an upper coil pattern 1231 supported by an upper surface of the support member 121 and a lower coil pattern 1232 supported by a lower surface of the support member 121. The upper coil pattern 1231 may have a T-shaped cross section of which a width of an upper surface is greater than that of a lower surface, and the lower coil pattern 1232 may have a rectangular cross section of which widths of an upper surface and a lower surface are substantially the same as each other.

The upper coil pattern 1231 may include the seed layer 1231*a* filled in the opening of the second insulating layer 1212 and the plating layer 1231*b* disposed on the seed layer 1231*a*. The plating layer 1231*b* may fill the opening 122*h* of the insulator 122. An upper surface of the seed layer 1231*a* may be a surface on which predetermined treatment is completed. For example, the upper surface of the seed layer 1231*a* may be a surface on which etching treatment is completed. A shape of the upper surface of the seed layer 1231*a* may be flat or a concave toward the support member 121, and may be appropriately controlled by those skilled in the art at the time of performing the predetermined treatment applied to the upper surface of the seed layer 1231*a*.

A maximum thickness of the seed layer 1231*a* may be the same as or smaller than the thickness of the second insulating layer 1212. The reason is that the possibility that a short-circuit between adjacent coil patterns will occur is decreased when the maximum thickness of the seed layer 1231*a* is the same as or smaller than the thickness of the second insulating layer 1212.

The plating layer 1231*b* disposed on the seed layer 1231*a* may fill the opening 122*h* of the insulator 122, and a thickness of the plating layer may not exceed a thickness of the insulator 122.

The lower coil pattern 1232 having a cross-sectional shape different from that of the upper coil pattern 1231 may be disposed to be in direct contact with a lower surface of the first insulating layer 1211 without the second insulating layer interposed therebetween. The lower coil pattern 1232 may not include a separate seed layer. The reason is that a seed layer for forming the lower coil pattern is removed in a final structure of the inductor, as described in a manufacturing process to be described below.

Meanwhile, since the inductor 100 has a structure in which a lower surface of the insulator 122 that separates the upper coil patterns 1231 from each other is not supported directly by the first insulating layer 1211 while being in direct contact with the second insulting layer 1212, but is supported directly by the second insulating layer 1212, collapse of the insulator 122 or occurrence of a delamination phenomenon of the insulator 122 from the support member 121 may be significantly decreased.

An insulating portion 124 may be disposed for insulation between an upper surface of the upper coil pattern 1231 and the magnetic material 11 and between a lower surface of the lower coil pattern 1232 and the magnetic material 11. The insulating portion 124 may be formed by performing oxidation treatment on only the upper surface of the upper coil pattern 1231 and the lower surface of the lower coil pattern 1232 so that the upper surface of the upper coil pattern 1231 and the lower surface of the lower coil pattern 1232 have an insulation property. Alternatively, the insulating portion 124 may be configured to include an insulating coating layer surrounding exposed surfaces of the support member 121 as well as the entirety of the coil portion by laminating an insulating film or performing chemical vapor deposition (CVD) on a resin having an insulation property.

According to the inductor 100 described above, a thickness of the support member 121 may be significantly decreased and the support member 121 may be configured doubly in a region in which the insulator 122 is supported by the support member 121, such that the support member 121 may appropriately support the coil pattern having a high aspect ratio. Resultantly, a demand for provision of an inductor having a low profile and including a coil pattern a high aspect ratio may be satisfied.

Method of Manufacturing Inductor

Next, a method of manufacturing the inductor 100 will be described. A method to be described below is only an example of a method of manufacturing the inductor 100.

Figure 3A:
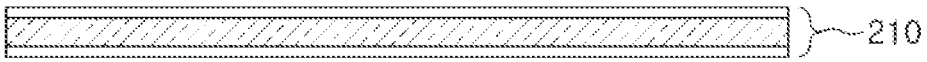
FIGS. 3A through 3N are schematic views illustrating processes of a method of manufacturing an inductor according to an exemplary embodiment in the present disclosure.

First, as shown in FIG. 3A, a substrate 210 may be prepared (S101). The substrate 210 may be any known copper clad laminate (CCL), but is not limited thereto. The substrate 210 may include a center core having an insulation property and conductive materials thinly coated on upper and lower surfaces of the center core.

Figure 3B:
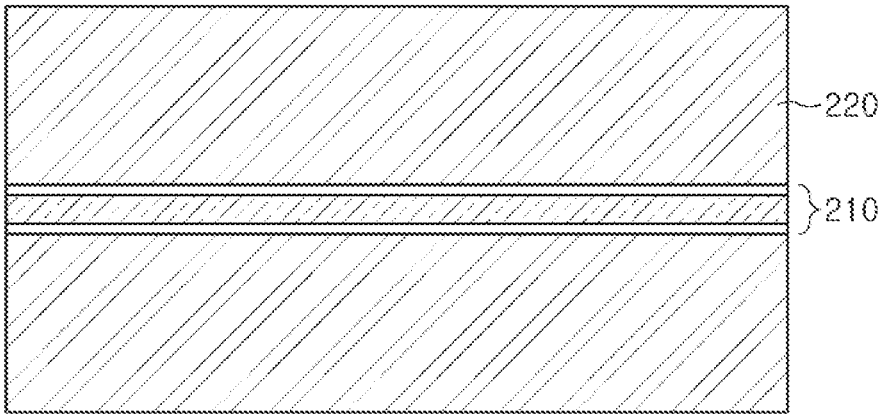

Then, as shown in FIG. 3B, first insulators 220 may be laminated on upper and lower surfaces of the substrate (S102). A thickness of the first insulator 220 may be appropriately selected, but may be greater than a thickness of a demanded lower coil pattern in consideration of the thickness of the demanded lower coil pattern. The first insulator 220 may be formed by stacking a plurality of insulating sheets or may be a single first insulator.

Figure 3C:
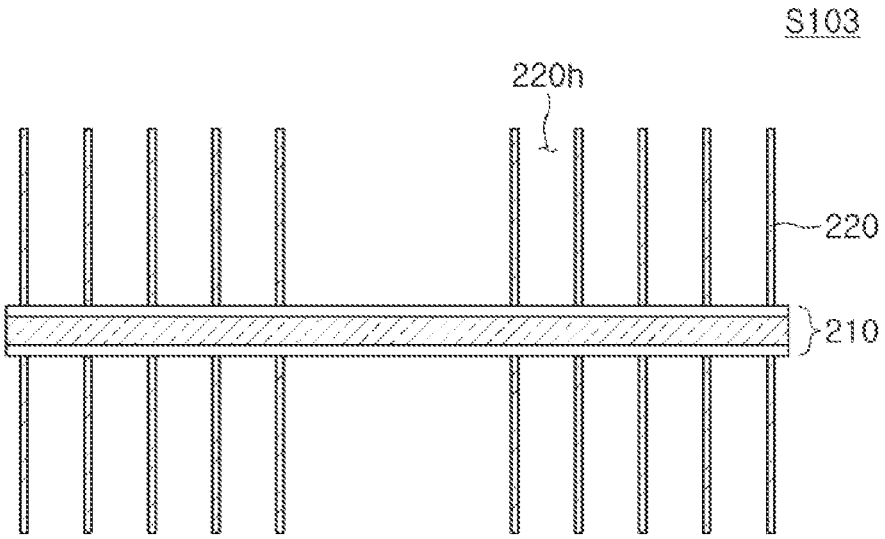
Figure 3D:
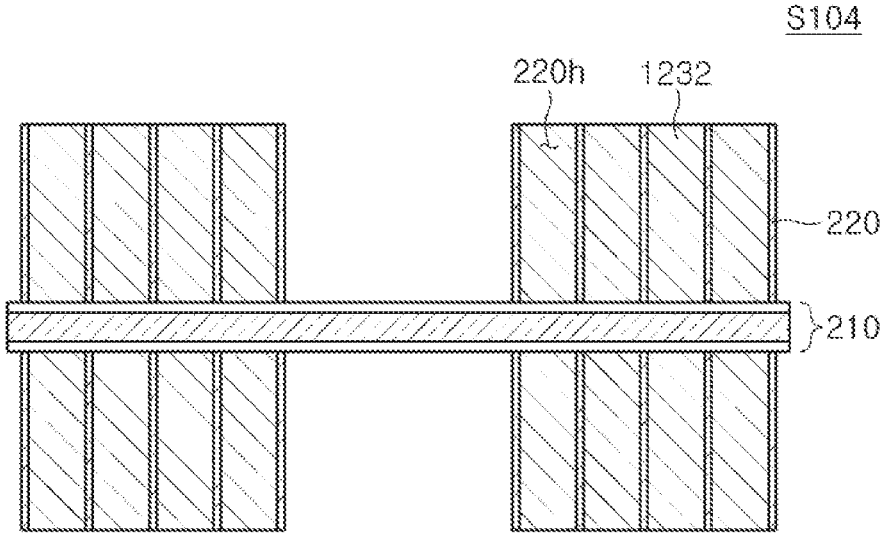

As shown in FIG. 3C, the first insulators 220 may be patterned to have predetermined opening patterns (S103). A method of patterning the first insulator 220 is not limited thereto, but may include exposure and development processes. The predetermined opening pattern may have a spiral shape in consideration of a final shape of a lower coil pattern, and a cross section of the opening pattern cut in an L-T direction may have a rectangular shape.

Then, as shown in FIG. 4, a lower coil pattern 1232 may be formed in openings 220*h* of the opening patterns of the first insulators 220. The coil pattern 230 may be plated using a conductive material included in the substrate 210 as a seed layer. A plating manner may be electroplating or electroless plating, and may be appropriately selected by those skilled in the art. A plating process may be performed so that an upper surface of the lower coil pattern 1232 is disposed on the same level as that of an upper surface of the first insulator 220 or is disposed on a level below the upper surface of the first insulator. When thicknesses of the first insulator 220 and the lower coil pattern 1232 substantially coincide with each other, an additional polishing process may not be required. However, when the thickness of the first insulator 220 is greater than that of the lower coil pattern 1232, a polishing process may be performed such that the upper surfaces of the lower coil pattern 1232 and the first insulator 220 may be coplanar with each other.

Figure 3E:
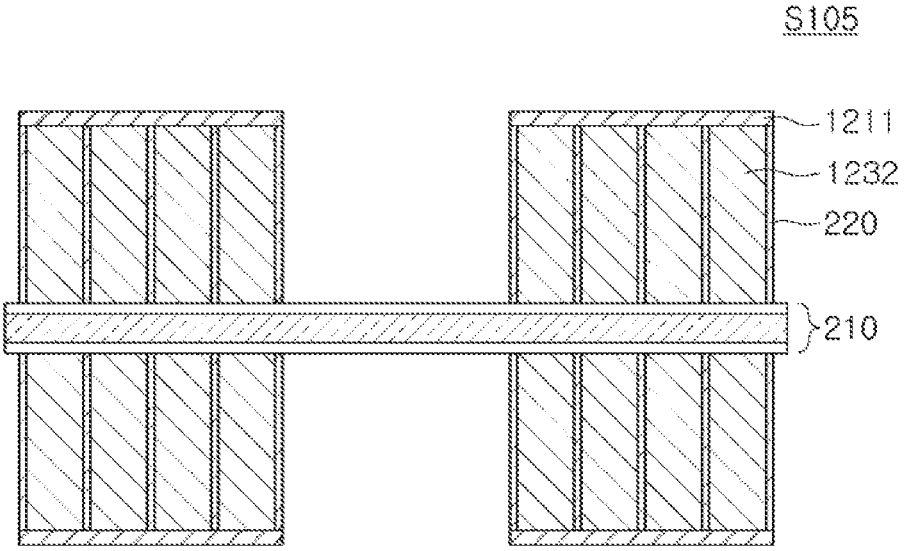
Figure 3F:
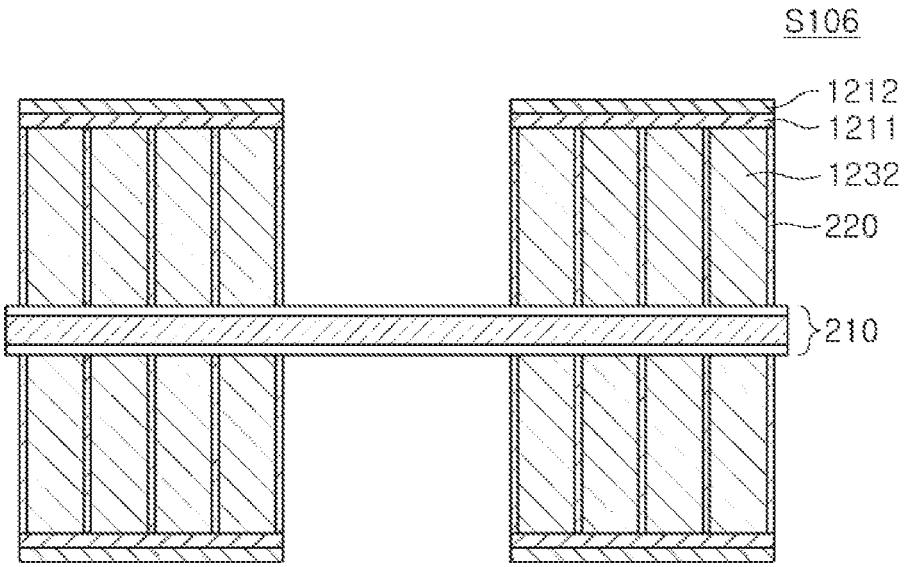

Then, as shown in FIG. 3E, first insulating layers 1211 may be laminated on the first insulators 220 and the lower coil pattern 1232 (S105). The first insulating layer 1211 may have a thickness significantly smaller than that of the substrate 210, and may have a small thickness of approximately 10 μm. A specific material of the first insulating layer 1211 is not particularly limited as long as it has an insulation property, and may be, for example, a PID resin or an ABF, but is not limited thereto.

Second insulating layers 1212 may be laminated on the first insulating layers 1211 (S106). The second insulating layer 1212 may be formed of the same material as that of the first insulating layer 1211, but may also be formed of a material different from that of the first insulating layer 1211.

Figure 3G:
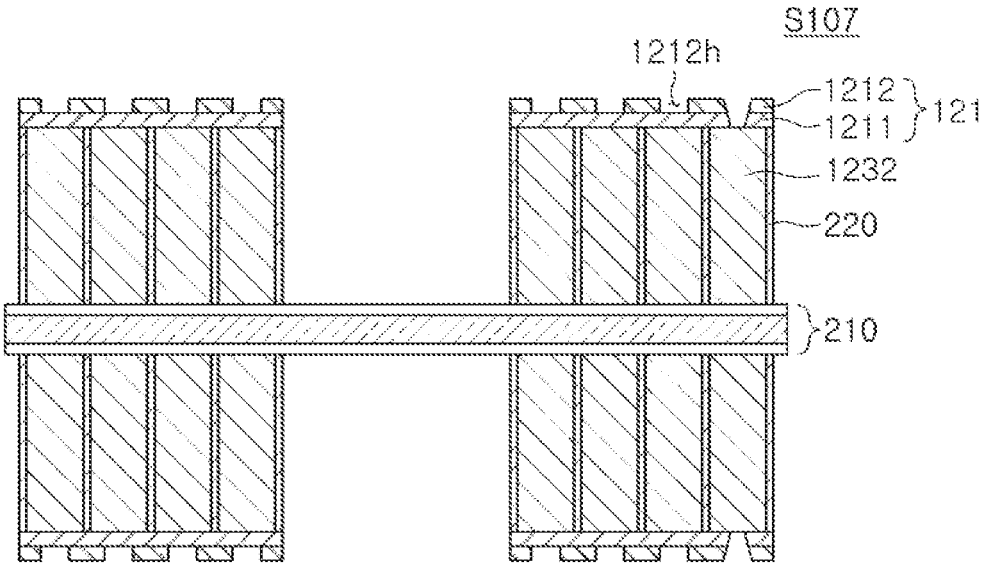

Referring to FIG. 3G, a patterning process may be formed on the second insulating layers 1212 in order to form openings 1212*h* in the second insulating layers 242 (S107). A specific manner of the patterning process may be changed depending on characteristics of the material of the second insulating layer 1212. For example, when the second insulating layer 1212 is formed of a photosensitive insulating material, the patterning process may be performed using exposure and development. Otherwise, the patterning process may be performed using a laser beam. A width of the opening 1212*h* may be smaller than that of the first insulator 220. Portions of the first insulating layers 1211 covered with the second insulating layers 1212 maybe exposed by the opening 1212*h* of the second insulating layers 242.

Figure 3H:
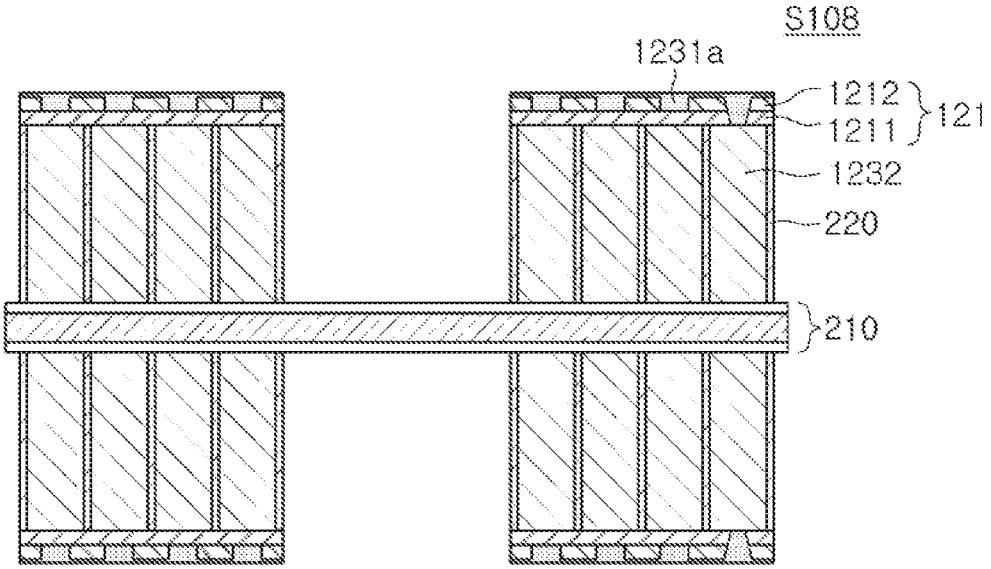

Then, as shown in FIG. 3H, a thin film conductor layer 1231*a* may be formed on the first and second insulating layers 1212 (S108). The thin film conductor layer 1231*a* is a layer filling at least portions of the openings 1212*h* of the second insulating layer 1212, and may thus be configured to be in direct contact with the first insulating layer 1211. The thin film conductor 1231*a* layer may be continuously coated up to an upper surface and side surfaces of the second insulating layer 1212 as well as in the openings 1212*h* of the second insulating layer 1212.

Figure 3I:
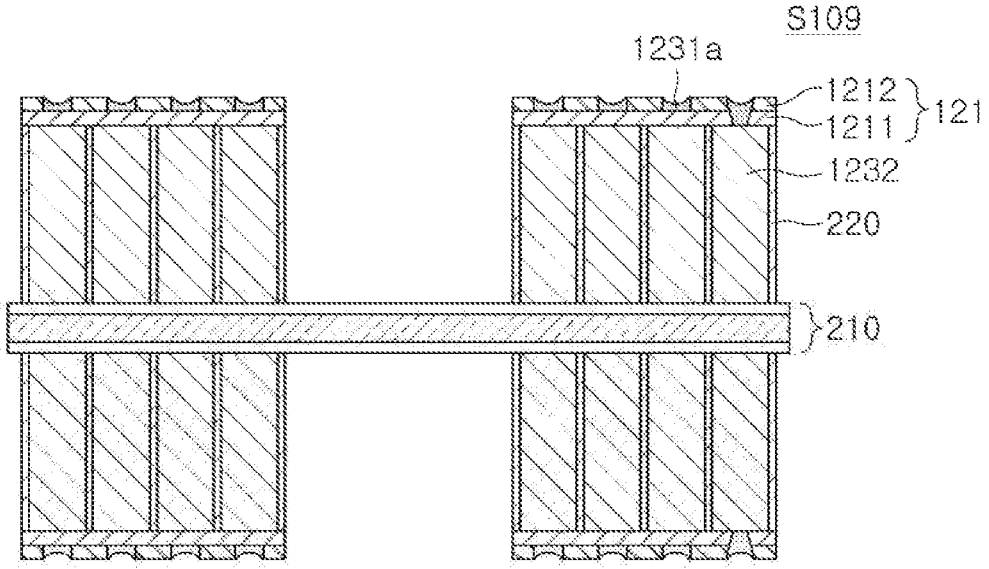

As shown in FIG. 3I, at least portions of the thin film conductor layer 1231*a* may be removed to allow the thin film conductor layer 1231*a* to have disconnected patterns disposed on upper surfaces of the second insulating layers 1212 (S109). As such, the disconnected patterns of the remaining thin film conductor layer 1231*a* becomes a seed layer. A manner of removing portions of the thin film conductor layer 1231*a* may be, for example, chemical etching, those skilled in the art may perform quick etching so that the thin film conductor layer 1231*a* may be disconnected on the upper surface of the second insulating layer 1212 while filling at least portions of the opening 1212*h* of the second insulating layer 1212, and a concentration of etchant, an etching time, or the like, may be appropriately selected.

Figure 3J:
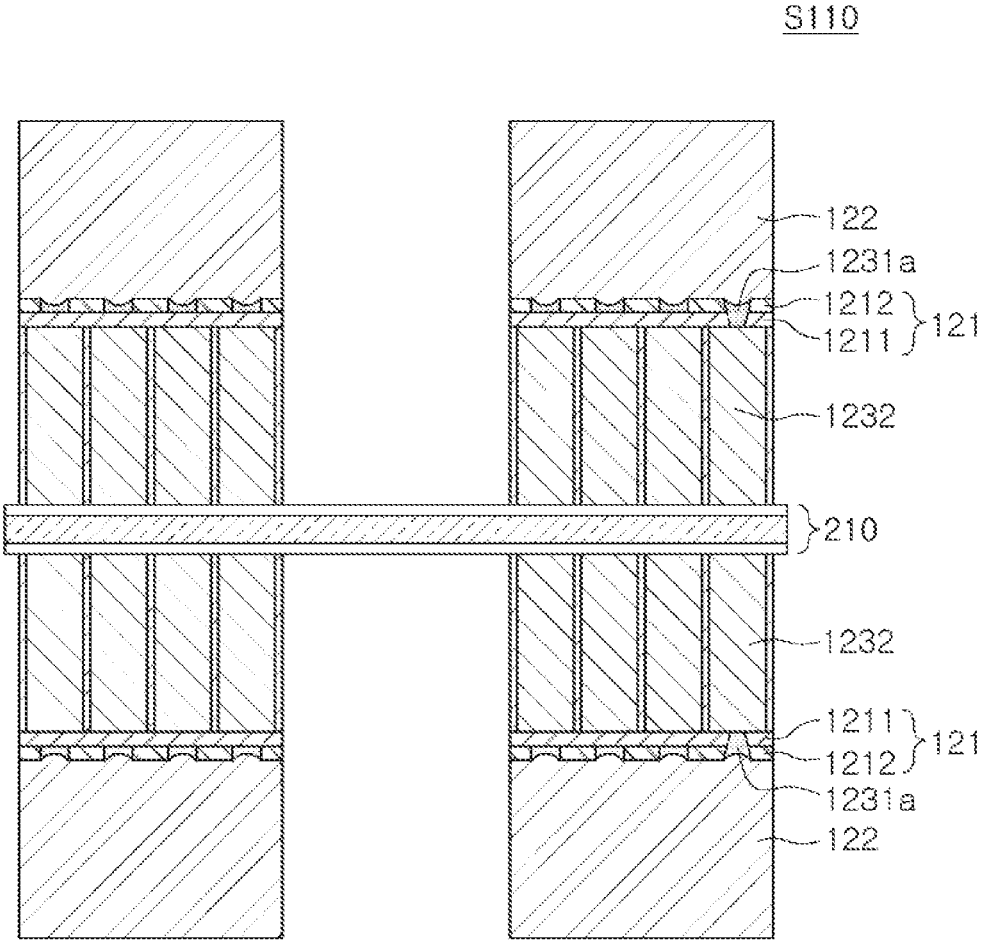

Then, as shown in FIG. 3J, second insulators 122 may be laminated so that the thin film conductor layers 1231*a* are buried therein (S110). The second insulator 122 may be a component that is substantially the same as the first insulator 220 laminated on the substrate 210, but different materials and thicknesses of the first and second insulators 220 and 122 may be selected as needed by those skilled in the art.

Figure 3K:
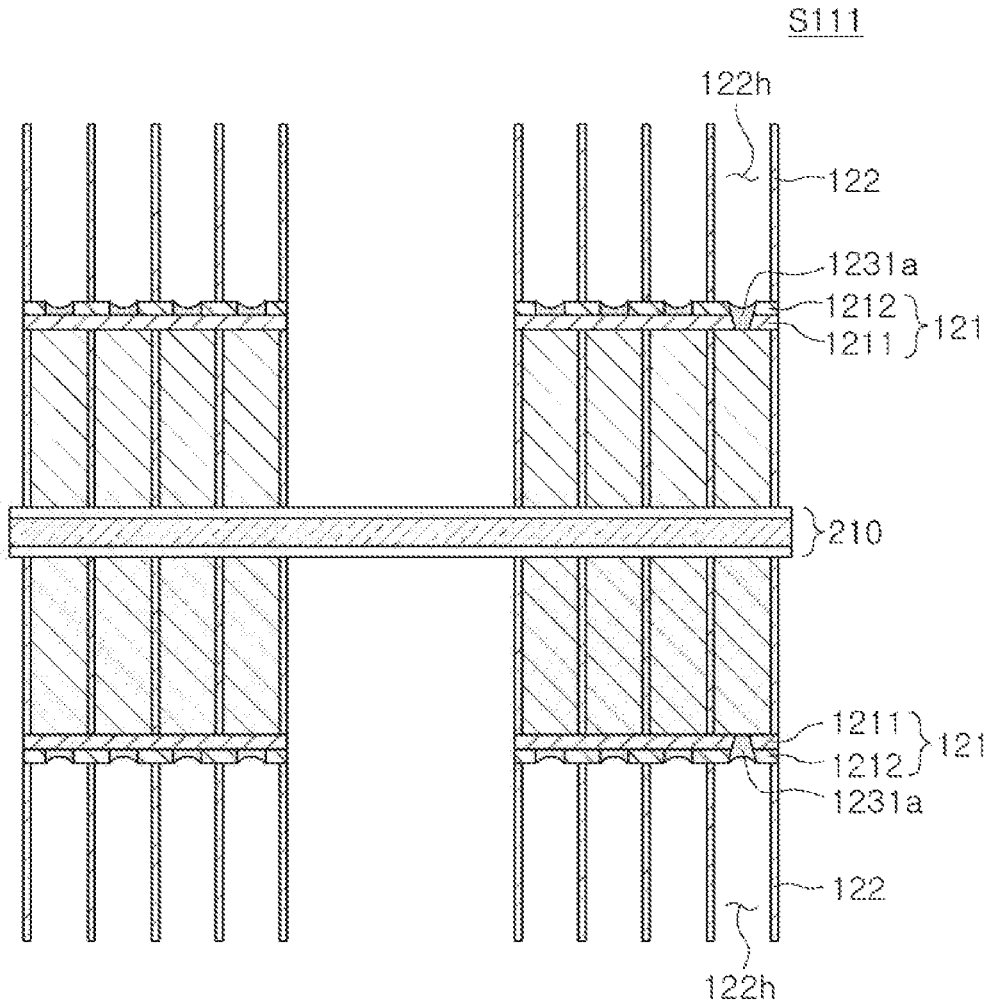

Then, as shown in FIG. 3K, the second insulators 122 may be patterned to include openings 122*h* corresponding to those of the first insulators 220 (S111). The openings 122*h* formed by patterning the second insulator 122 may be openings 122*h* corresponding to those of the first insulator 220. The reason is that coil pattern is filled in the openings 220*h* and 122*h*, and the openings 220*h* and 122*h* of the first and second insulators 220 and 122 thus need to correspond to each other in order to align the coil patterns with each other.

Figure 3L:
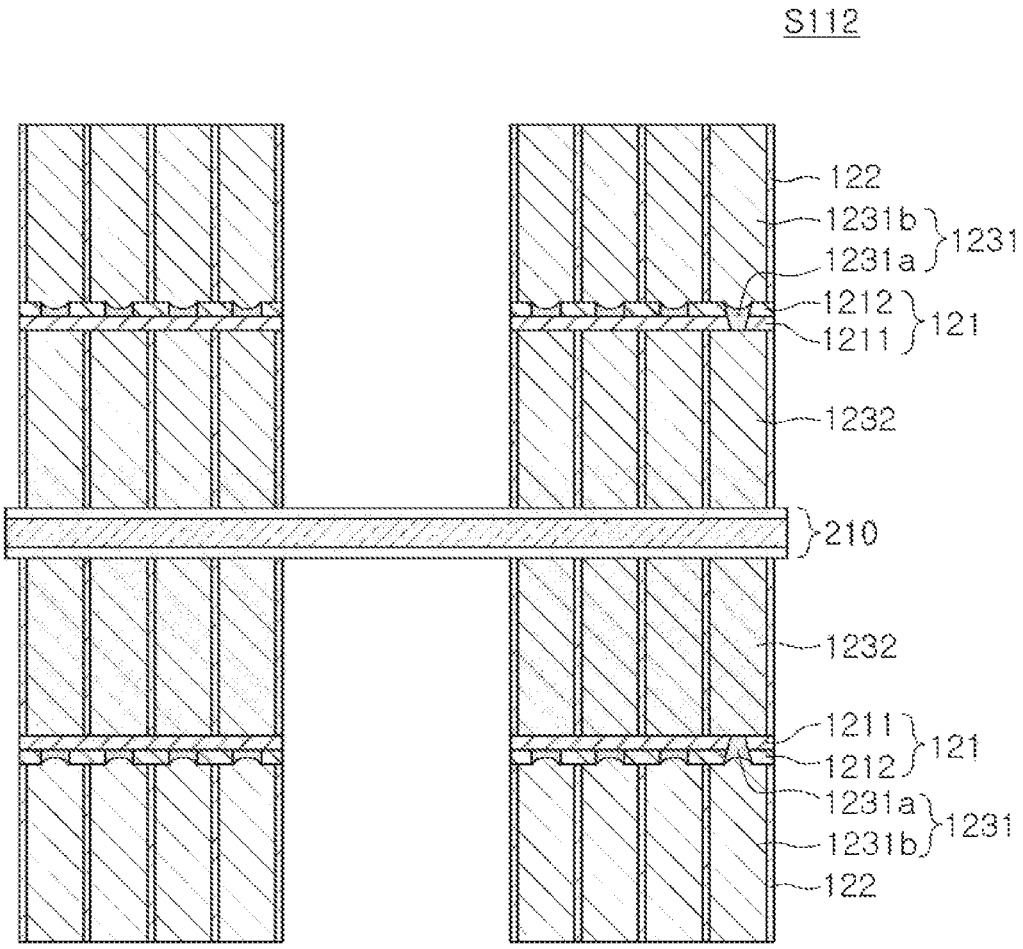

As shown in FIG. 3L, the plating layer 1231*b* of the upper coil pattern 1231 may be filled in the openings 122*h* of the second insulators 122 (S112). The plating layer 1231*b* may be formed by a plating process on the basis of the thin film conductor layer 1231*a* as a seeding layer to fill the openings 122*h* of the second insulating layer 122. A thickness of the plating layer 1231*b* is not particularly limited, but may be the same as or smaller than that of the second insulator 122 in order to prevent a short-circuit between adjacent coil patterns of the upper coil pattern 1231. Optionally, a predetermined polishing process may be performed in order to allow the thickness of the second insulator 122 and the thickness of the upper coil pattern 1231 to coincide with each other.

Figure 3M:
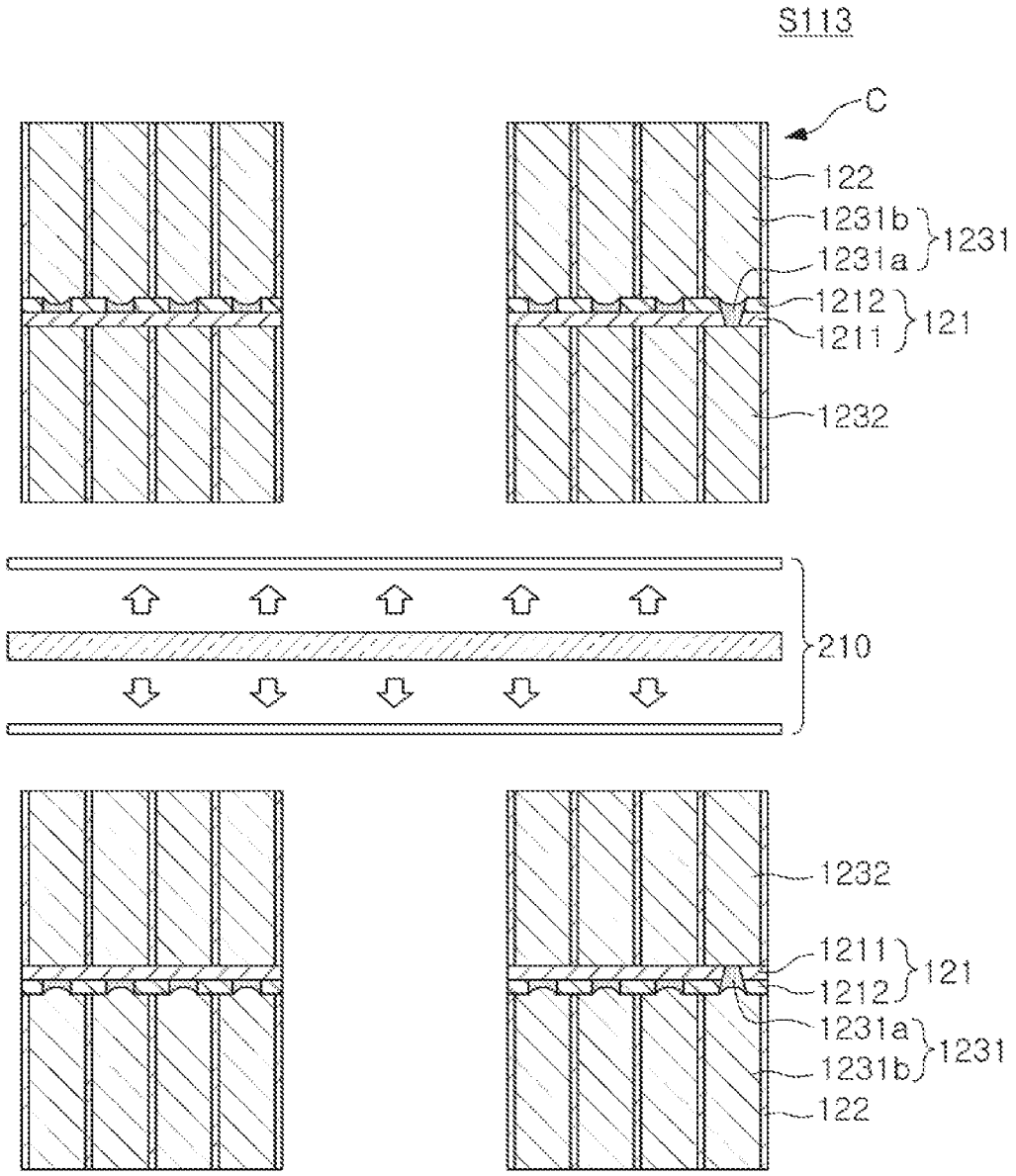

Then, as shown in FIG. 3M, the substrate 210 maybe removed (S113). Coil portions C formed on and beneath the substrate 210 may be separated from each other by removing the substrate 210. Resultantly, two coil portion C that are substantially the same as each other may be secure through one substrate 210. The removal of the substrate means that the conductive materials, acting as a seeding layer to form the lower coil pattern 1232, attached to the upper and lower surfaces of the center core of the substrate 210 as well as the center core of the substrate 210 are removed by etching, or the like.

Figure 3N:
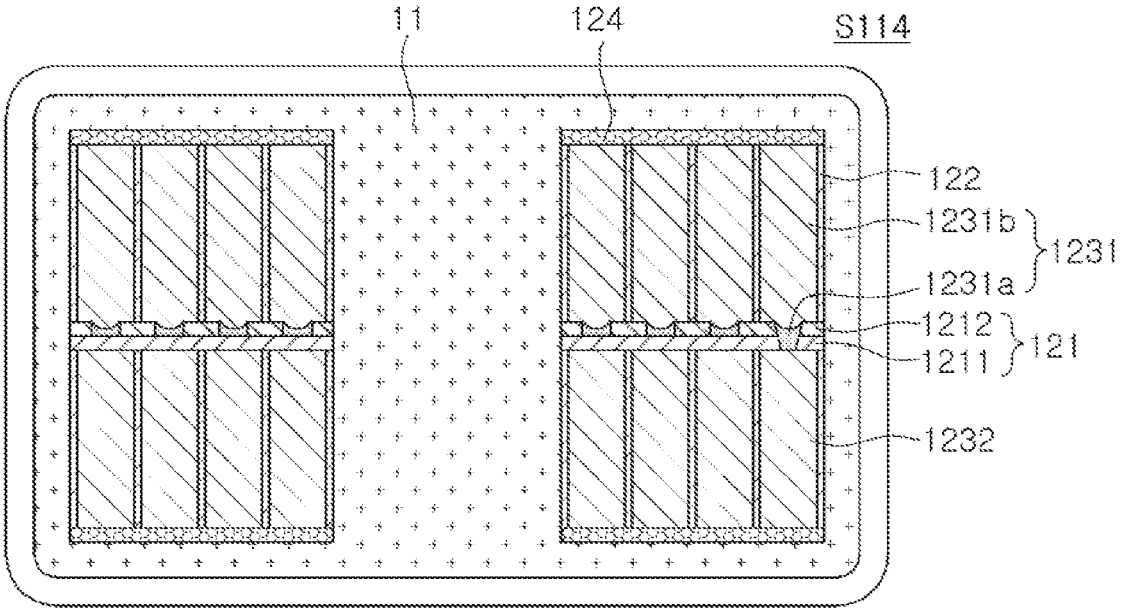

As shown in FIG. 3N, a process (S114) of disposing an insulating portion 124 on an upper surface of the upper surface of the upper coil pattern 1231 and the lower surface of the lower coil pattern 1232, and encapsulating the coil portion and filling the core portion with a magnetic material, forming a lead portion of the coil portion to connect the coil portion to an external electrode may be performed.

A description for features overlapping those of the inductor according to the exemplary embodiment in the present disclosure described above except for the abovementioned description is omitted.

As set forth above, according to the exemplary embodiment in the present disclosure, an inductor having a low profile and including a coil pattern having a high aspect ratio, and a method of manufacturing the same may be provided.

While exemplary embodiments have been shown and described above, it will be apparent to those skilled in the art that modifications and variations could be made without departing from the scope of the present invention as defined by the appended claims.

What is claimed is:

1. An inductor comprising:

a body including a support member including a through-hole and a via hole, an insulator disposed on the support member and including a first opening exposing portions of the support member, an upper coil pattern disposed in the first opening, and a lower coil pattern disposed on the support member; and an external electrode disposed on an external surface of the body and connected to the one of the upper coil pattern and the lower coil pattern, wherein the support member has a multilayer structure of at least first and second insulating layers being in contact with each other, and the via hole penetrates through both of the first and second insulating layers, the second insulating layer includes a second opening, provided in each turn of the upper coil pattern, having a shape corresponding to that of the first opening of the insulator, the inductor further includes a seed layer disposed in the second opening to be in contact with the support member, and the second insulating layer is disposed between the upper coil pattern and the lower coil pattern.

2. The inductor of claim 1, wherein a width of the second opening of the second insulating layer is smaller than that of the first opening of the insulator.

3. The inductor of claim 1, wherein a thickness of the first insulating layer is 10 μm or more and less than 60 μm, and a thickness of the second insulating layer is 5 μm or more to 20 μm or less.

4. The inductor of claim 1, wherein the upper coil pattern is disposed on one surface of the support member and the lower coil pattern is disposed on the other surface of the support member opposing the one surface.

5. The inductor of claim 1, wherein the upper coil pattern and the lower coil pattern are connected to each other the seed layer disposed in the via hole.

6. The inductor of claim 1, wherein the upper coil pattern has a T-shaped cross-sectional shape of which a width of a lower surface is smaller than that of an upper surface, and the lower coil pattern has a rectangular cross-sectional shape.

7. The inductor of claim 1, wherein the lower coil pattern does not include the seed layer.

8. The inductor of claim 1, wherein the first insulating layer includes a glass filler, a photoimagable dielectric (PID) resin, an Ajinomoto build-up film (ABF), or FR-4.

9. The inductor of claim 1, wherein the second insulating layer includes a PID resin or an ABF.

10. The inductor of claim 1, wherein the second opening has a spiral shape.

11. An inductor comprising:

a body including a support member including a through-hole and a via hole spaced apart from the through-hole, an insulator disposed on the support member and including a first opening exposing portions of the support member, an upper coil pattern disposed in the first opening, and a lower coil pattern disposed on the support member; and an external electrode disposed on an external surface of the body and connected to one of the upper coil pattern and the lower coil pattern, wherein the support member has a multilayer structure of at least first and second insulating layers, and the via hole penetrates through both of the first and second insulating layers, the second insulating layer includes a second opening having a spiral shape corresponding to a shape of the first opening of the insulator, the inductor further includes a seed layer disposed in the second opening to be in contact with the support member, and the second insulating layer is disposed between the upper coil pattern and the lower coil pattern.

12. The inductor of claim 11, wherein a width of an opening of the second insulating layer is smaller than that of the first opening of the insulator.

13. The inductor of claim 11, wherein the upper coil pattern is disposed on one surface of the support member and the lower coil pattern is disposed on the other surface of the support member opposing the one surface.

14. The inductor of claim 11, wherein the upper coil pattern and the lower coil pattern are connected to each other by the seed layer disposed in the via hole.

15. The inductor of claim 11, wherein the upper coil pattern has a T-shaped cross-sectional shape of which a width of a lower surface is smaller than that of an upper surface, and the lower coil pattern has a rectangular cross-sectional shape.

16. The inductor of claim 11, wherein the lower coil pattern does not include the seed layer.

17. An inductor comprising:

a body including a support member including a through-hole and a via hole, an insulator disposed on the support member and including a first opening exposing portions of the support member, and an upper coil pattern disposed in the first opening, and a lower coil pattern disposed on the support member; and an external electrode disposed on an external surface of the body and connected to one of the upper coil pattern and the lower coil pattern, wherein the support member has a multilayer structure of at least first and second insulating layers, and the via hole penetrates through both of the first and second insulating layers, the second insulating layer includes a second opening, provided in each turn of the coil pattern, having a shape corresponding to that of the first opening of the insulator, the inductor further includes a seed layer disposed in the second opening to be in contact with the support member, and the second insulating layer is disposed between the upper coil pattern and the lower coil pattern.

18. The inductor of claim 17, wherein a width of the second opening of the second insulating layer, in which the seed layer is disposed in, is smaller than that of the first opening of the insulator.

* * * * *